US008262387B2

(12) United States Patent
Nishiyama et al.

(10) Patent No.: US 8,262,387 B2
(45) Date of Patent: Sep. 11, 2012

(54) ATMOSPHERE HEAT TREATMENT APPARATUS AND METHOD OF OPERATING THE SAME

(75) Inventors: Tomihiko Nishiyama, Aichi (JP); Hiroyoshi Suzuki, Tokyo (JP); Shinichi Takemoto, Tokyo (JP); Kouji Abe, Tokyo (JP); Toshiaki Ohashi, Tokyo (JP); Takashi Sakurai, Tokyo (JP)

(73) Assignees: Dowa Thermotech Co., Ltd., Tokyo (JP); Toyota Jidosha Kabushiki Kaisha, Aichi (JP)

( * ) Notice: Subject to any disclaimer, the term of this patent is extended or adjusted under 35 U.S.C. 154(b) by 965 days.

(21) Appl. No.: 11/883,569

(22) PCT Filed: Feb. 2, 2006

(86) PCT No.: PCT/JP2006/301764

§ 371 (c)(1),
(2), (4) Date: Apr. 4, 2008

(87) PCT Pub. No.: WO2006/082891

PCT Pub. Date: Aug. 10, 2006

(65) Prior Publication Data

US 2009/0142721 A1 Jun. 4, 2009

(30) Foreign Application Priority Data

Feb. 3, 2005 (JP) ..... 2005-027542

(51) Int. Cl.
*F28C 3/12* (2006.01)

(52) U.S. Cl. ..... 432/219; 266/252; 148/206

(58) Field of Classification Search ..... 432/29, 432/219; 266/252; 148/206
See application file for complete search history.

(56) References Cited

U.S. PATENT DOCUMENTS 5,225,144 A * 7/1993 Nanba et al. ..... 266/251
(Continued)

FOREIGN PATENT DOCUMENTS

JP 60-095428 U1 6/1985
(Continued)

OTHER PUBLICATIONS

International Search Report.

(Continued)

*Primary Examiner* — Gregory A Wilson
(74) *Attorney, Agent, or Firm* — Rader, Fishman & Grauer PLLC

(57) ABSTRACT

An object of the present invention is to provide an atmosphere heat treatment apparatus that is operable without relying on experiences and/or intuitions of an operator, and a method of operating the same. The atmosphere heat treatment apparatus includes an entrance side exhaust path (26) for exhausting an inside atmosphere from an entrance side of a carburizing chamber (10) to which a transforming gas is supplied, an exit side exhaust path (35) for exhausting the inside atmosphere from an exit side of the heat treatment chamber, and an opening degree adjusting lid (28) attached for adjusting an opening degree of the entrance side exhaust path (26), in which a part or whole of the exit side exhaust path (35) is constituted of a pipe (46) having a predetermined inside diameter. It is checked in advance a relationship of a supplying amount A of the transforming gas with a ratio B:C of an exhaust amount B from the exit side exhaust path (35) and an exhaust amount C from the entrance side exhaust path (26) when a pressure in the carburizing chamber (10) is adjusted to a predetermined furnace pressure by adjusting an opening degree of the entrance side exhaust path (26) with the opening degree adjusting lid (28), and when treating a work (W), the supplying amount A of the transforming gas and a furnace pressure are adjusted so as to control the ratio B:C of the exhaust amount B from the exit side exhaust path (35) and the exhaust amount C from the entrance side exhaust path (26) to be within a predetermined range.

21 Claims, 6 Drawing Sheets

U.S. PATENT DOCUMENTS

| | | | | |
|---|---|---|---|---|
| 5,868,871 | A * | 2/1999 | Yokose et al. | 148/211 |
| 6,767,504 | B2 * | 7/2004 | Hattori et al. | 266/81 |
| 7,029,625 | B2 * | 4/2006 | Shimosato et al. | 266/252 |

FOREIGN PATENT DOCUMENTS

| | | | |
|---|---|---|---|
| JP | 63-64766 | U | 6/1985 |
| JP | 63-064733 | U1 | 4/1988 |
| JP | 04-052212 | A | 2/1992 |
| JP | 04-063260 | A | 2/1992 |
| JP | 63-64766 | U | 4/1998 |
| JP | 11-001759 | A | 1/1999 |
| JP | 2004-010945 | A | 1/2004 |

OTHER PUBLICATIONS

Japanese Office Action issued Oct. 4, 2011 for corresponding Japanese Application No. 2007-501618.

* cited by examiner

ATMOSPHERE HEAT TREATMENT APPARATUS AND METHOD OF OPERATING THE SAME

TECHNICAL FIELD

The present invention relates to an atmosphere heat treatment apparatus such as a sequential gas conditioning apparatus, which is used for carburizing treatment of a work such as an automobile part, and a method of operating the same.

BACKGROUND ART

There is known a sequential gas carburizing apparatus in which a work such as an automobile part is carried through a carry-in chamber, a carburizing chamber and an oil tank chamber in this order for performing carburizing treatment thereon, and also the present applicant has disclosed, for example, Japanese Patent Application Laid-open No. H11-1759 (Patent Document 1).

[Patent Document 1]

Japanese Patent Application Laid-open No. H11-1759.

In such a sequential gas carburizing apparatus, in order to avoid unevenness in carburization due to differences in positions of works in a furnace, disturbance in furnace atmosphere due to flowing-in of the outside air into the furnace, or risk of explosion or the like due to flowing-in of the outside air, a transforming gas which is of approximately five to ten times the furnace capacity per hour is supplied into a carburizing chamber to thereby adjust the pressure in the carburizing chamber to a predetermined furnace pressure. In this case, for example, an entrance side exhaust path is provided in a carry-in chamber connected to the entrance side of the carburizing chamber, and an exit side exhaust path is provided in an oil tank chamber connected to the exit side of the carburizing chamber, so as to supply the transforming gas to the carburizing chamber. At the same time, the inside atmosphere is exhausted from both the entrance side and the exit side of the carburizing chamber, thereby burning the exhausted gas outside.

In the carburizing chamber, a preheating zone, a carburizing zone, a diffusing zone, a hardening heating zone, and so on are provided in order from the entrance side to the exit side, and among them, the hardening heating zone is kept at a lower temperature compared to the other zones. For example, in general, the preheating zone, the carburizing zone, the diffusing zone are kept at approximately 930° C., whereas the hardening heating zone is kept at approximately 850° C.

On the other hand, in the sequential gas carburizing apparatus, the inside of the carburizing chamber is kept at a predetermined carbon potential (CP) of 0.8% for example. However, the CP (carbon potential) tends to increase when the temperature of the inside atmosphere drops, and thus the CP increases when the inside atmosphere moves from the carburizing zone or the diffusing zone kept at approximately 930° C. to the hardening heating zone kept at approximately 850° C. for example. For example, the CP of approximately 0.8% in the carburizing zone or the diffusing zone which are kept at approximately 930° C. increases to approximately 1.0% in the hardening heating zone which is kept at approximately 850° C. Then, this increase of CP in the hardening heating zone makes the carburizing treatment on works unable to be controlled precisely.

Accordingly, the inside atmosphere of the entire carburizing chamber is kept at a target value (0.8% for example) as much as possible by exhausting the inside atmosphere of the carburizing chamber to the entrance side of the carburizing chamber as much as possible, and thereby making the exhaust amount to the exit side (hardening heating zone), where the CP increases by temperature drop, of the carburizing chamber relatively small. For example, by exhausting 70% to 80% of the inside atmosphere in the carburizing chamber to the entrance side, and exhausting the remaining 30% to 20% to the exit side, increase of the CP in the hardening heating zone is suppressed effectively, which allows keeping of the CP in the entire carburizing chamber almost at the target value (0.8% for example) regardless of positions, and thus the carburizing treatment becomes precisely controllable also during the hardening heating.

For this purpose, conventionally, an operator appropriately adjusts the opening degrees of the entrance side exhaust path and the exit side exhaust path so as to allow exhausting of the inside atmosphere in the carburizing chamber to the entrance side and the exit side by a predetermined ratio (7:8 to 8:2). In this case, the operator sees for example the size of flame or the like, which is exhausted to the outside of the furnace and burnt, and adjusts the exhaust amount from the entrance side exhaust path and the exhaust amount from the exit side exhaust path, thereby controlling the inside atmosphere in the carburizing chamber to be exhausted by the predetermined ratio to the entrance side and the exit side.

However, such conventional control often relies on experiences and/or intuitions of an operator, and thus objective judgment is not possible. Also, since an experienced operator is required for operating the apparatus, a human-related load becomes large, and hence reduction of labor cannot be realized.

DISCLOSURE OF THE INVENTION

Problems to be Solved by the Invention

Therefore, an object of the present invention is to provide an atmosphere heat treatment apparatus that is operable without relying on experiences and/or intuitions of an operator, and a method of operating the same.

Means for Solving the Problems

According to the present invention, there is provided an atmosphere heat treatment apparatus, which is characterized by including an entrance side exhaust path for exhausting an inside atmosphere from an entrance side of a heat treatment chamber to which a transforming gas is supplied, an exit side exhaust path for exhausting the inside atmosphere from an exit side of the heat treatment chamber, and an opening degree adjusting lid attached for adjusting an opening degree of the entrance side exhaust path, in which a part or whole of the exit side exhaust path is constituted of a pipe having a predetermined inside diameter.

A carry-in chamber for carrying in a work into the heat treatment chamber may be provided on the entrance side of the heat treatment chamber chamber, and the entrance side exhaust path may be provided in the carry-in chamber. Also, an oil tank chamber for hardening a work may be provided on the exit side of the heat treatment chamber, and the exit side exhaust path may be provided on the oil tank chamber.

Further, an outside air intake path for taking in outside air, and an opening/closing mechanism for opening/closing the outside air intake path may be included. Also, an oil tank chamber for hardening a work may be provided on the exit side of the heat treatment chamber, and the outside air intake path may be provided on the oil tank chamber. An entrance end of the exit side exhaust path may be connected to the outside air intake path between the opening/closing mechanism and an exit end of the outside air intake path.

Also, a burner which consumes oxygen in the outside air taken in from the outside air intake path for combustion may be included, and the opening/closing mechanism may be provided between the burner and the exit end of the outside air intake path. An exit end of the exit side exhaust path may be connected to the outside air intake path between the burner and the opening/closing mechanism.

The exit side exhaust path may be attached to the opening/closing mechanism. A pilot burner for igniting the inside atmosphere exhausted by the exit side exhaust path may be further included. The heat treatment chamber may be a carburizing chamber.

Also, according to the present invention, there is provided a method of operating an atmosphere heat treatment apparatus including an entrance side exhaust path for exhausting an inside atmosphere from an entrance side of a heat treatment chamber to which a transforming gas is supplied, an exit side exhaust path for exhausting the inside atmosphere from an exit side of the heat treatment chamber, and an opening degree adjusting lid attached for adjusting an opening degree of the entrance side exhaust path, in which a part or whole of the exit side exhaust path is constituted of a pipe having a predetermined inside diameter, and the method is characterized by including checking in advance a relationship of a supplying amount A of the transforming gas with a ratio B:C of an exhaust amount B from the exit side exhaust path and an exhaust amount C from the entrance side exhaust path when a pressure in the heat treatment chamber is adjusted to a predetermined furnace pressure by adjusting an opening degree of the entrance side exhaust path with the opening degree adjusting lid, and when treating a work, adjusting the supplying amount A of the transforming gas and a furnace pressure so as to control the ratio B:C of the exhaust amount B from the exit side exhaust path and the exhaust amount C from the entrance side exhaust path to be within a predetermined range.

The atmosphere heat treatment apparatus may include an outside air intake path for taking in outside air, and when the outside air intake path is opened, oxygen in the outside air may be consumed for combustion, and then the outside air may be taken in via the outside air intake path.

Also, when outside air flows into the apparatus through the exit side exhaust path when a pressure in the apparatus becomes a negative pressure, oxygen in the outside air flowing into the exit side exhaust path may be consumed for combustion. In this case, oxygen in the outside air taken in from the outside air intake path and oxygen in the outside air flowing in from the exit side exhaust path may be consumed for combustion by a same burner.

The inside atmosphere exhausted by the exit side exhaust path may be ignited by a pilot burner. The heat treatment chamber may be a carburizing chamber.

Effect of the Invention

When a part or whole of the exit side exhaust path is constituted of a pipe having a predetermined diameter, and a pressure in the heat treatment chamber is adjusted to a constant furnace pressure, the amount of gas exhausted from the exit side exhaust path becomes constant. Thus, when the supply amount A of the transforming gas is increased and the furnace pressure is made constant while a pressure in the heat treatment chamber is kept at a desired furnace pressure, the amount of exhausted gas from the exit side exhaust path is constant, which results in that the amount of gas exhausted from the entrance side exhaust path is increased by the amount of the increase of the supply amount A. Accordingly, by checking in advance the pressure (furnace pressure) in the heat treatment chamber, and the relationship of the supply amount A of the transforming gas with the ratio B:C of the exhaust amount B from the exit side exhaust path and the exhaust amount C from the entrance side exhaust path, it becomes possible to treat a work in a predetermined state. According to the present invention, it becomes possible to exhaust the inside atmosphere of the heat treatment chamber to the entrance side and the exit side by a desired ratio without relying on experiences or intuitions of an operator. Accordingly, the CP of the entire heat treatment chamber can be kept almost constant regardless of positions, and hence the carburizing treatment can be controlled precisely. Also according to the present invention, getting off of balance can be determined by seeing an upper and lower limits of the furnace pressure as long as jamming in the exit side exhaust path and the entrance side exhaust path are prevented.

EXPLANATION OF CODES

Figure 1:
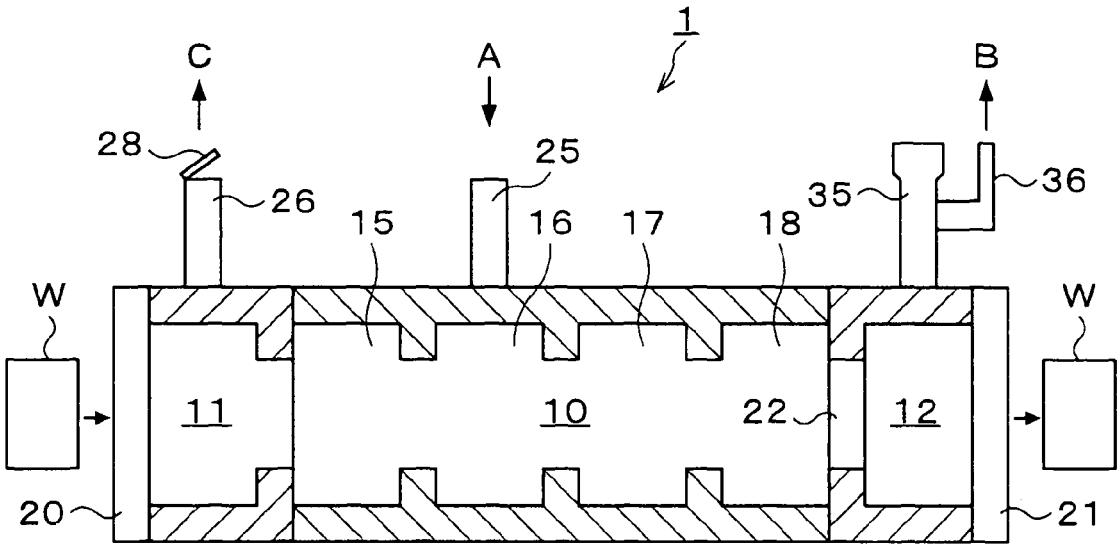
FIG. 1 A schematic vertical cross-sectional view for explaining a sequential gas carburizing apparatus according to an embodiment of the present invention.

W work
1 sequential gas carburizing apparatus
10 carburizing chamber
11 carry-in chamber
12 oil tank chamber
15 preheating zone
16 carburizing zone
17 diffusing zone
18 hardening heating zone
25 gas supply path
26 entrance side exhaust path
28 opening degree adjusting lid
35 outside air intake path
36 exit side exhaust path
40 lid
41 burner
46 cylindrical pipe
50 pilot burner
62 opening/closing mechanism

BEST MODE FOR CARRYING OUT THE INVENTION

Figure 2:
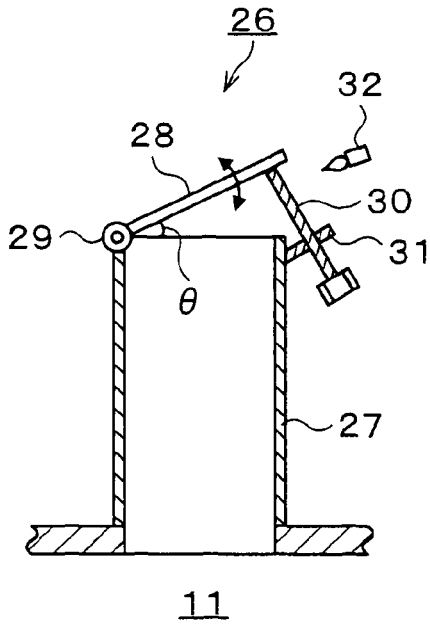
FIG. 2 A vertical cross-sectional view of an entrance side exhaust path.
Figure 3:
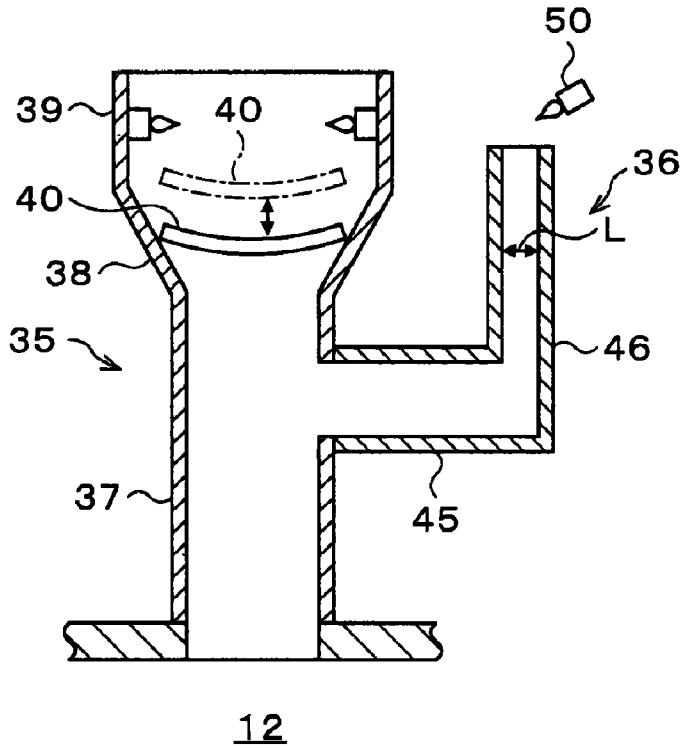
FIG. 3 A vertical cross-sectional view of an outside air intake path having an exit side exhaust path.

Hereinafter, preferred embodiments of the present invention will be described with reference to the drawings, based on a sequential gas carburizing apparatus as an example of an atmosphere heat treatment apparatus. FIG. 1 is a schematic vertical cross-sectional view for explaining a sequential gas carburizing apparatus 1 according to an embodiment of the present invention. FIG. 2 is a vertical cross-sectional view of an entrance side exhaust path 26. FIG. 3 is a vertical cross-sectional view of an outside air intake path 35 having an exit side exhaust path 36.

As shown in FIG. 1, the sequential gas carburizing apparatus 1 has a carburizing chamber 10 as a heat treatment chamber, and a carry-in chamber 11 for carrying a work W into the carburizing chamber 10 is provided on an entrance side (left side of the carburizing chamber 10 in FIG. 1) of the carburizing chamber 10, and an oil tank chamber 12 for oil hardening the work W is provided on an exit side (right side of the carburizing chamber 10 in FIG. 1) of the carburizing chamber. Inside the carburizing chamber 10, a preheating zone 15, a carburizing zone 16, a diffusing zone 17 and a hardening heating zone 18 are provided in order from the entrance side to the exit side. Although not shown, not-shown heaters are provided respectively in these preheating zone 15, carburizing zone 16, diffusing zone 17 and hardening heating zone 18, and the zones 15 to 18 can be heated to arbitrary atmospheric temperatures respectively.

One side face of the carry-in chamber 11 (left side face of the carry-in chamber 11 in FIG. 1) is constructed to be opened and closed by a door 20. Similarly, one side face of the oil tank chamber 12 (right side face of the oil tank chamber 12 in FIG. 1) is also constructed to be opened and closed by a door 21. Further, a door 22 is provided between the other side face of the oil tank chamber 12 (left side face of the oil tank chamber 12 in FIG. 1) and the hardening heating zone 18, and the door 22 opens and closes the hardening heating zone 18, and also opens and closes the other side face of the oil tank chamber 12.

To an upper face of the carburizing chamber 10, there is connected a gas supply path 25 for supplying a transforming gas produced in a not-shown transforming furnace to the inside. Through this gas supply path 25, an enrich gas can also be supplied to the inside of the carburizing chamber 10.

On an upper face of the carry-in chamber 11, there is provided an entrance side exhaust path 26 for exhausting the inside atmosphere from the entrance side of the carburizing chamber 10. As shown in FIG. 2, the entrance side exhaust path 26 has an entrance side exhaust path body 27 in a cylindrical shape, which is in communication with the inside of the carry-in chamber 11, and the inside atmosphere of the carburizing chamber 10 is exhausted to the outside through this entrance side exhaust path body 27. On an upper end of the entrance side exhaust path body 27, there is attached an opening degree adjusting lid 28 for adjusting the opening degree of the entrance side exhaust path 26 in an openable/closable manner with a hinge 29. A tip portion of the opening degree adjusting lid 28 (end portion located opposite to a base end portion attached rotatably on the upper end of the entrance side exhaust path body 27 via the hinge 29) is pushed up by a tip of a screw rod 30. The screw rod 30 is screwed through a plate 31 attached on an outside of the upper end of the entrance side exhaust path body 27, and by turning the screw rod 31, a projecting amount of the tip of the screw rod 30 screwed through the plate 31 changes, and accordingly, a pushed-up amount of the tip portion of the opening degree adjusting lid 28 changes. When the projecting amount of the tip of the screw rod 30 is increased by turning the screw rod 30, the pushed-up amount of the tip portion of the opening degree adjusting lid 28 increases, and the opening degree of the entrance side exhaust path 26 (opening angle θ of the opening degree adjusting lid 28) becomes large. Inversely, when the projecting amount of the tip of the screw rod 30 is decreased by turning the screw rod 30, the pushed-up amount of the tip portion of the opening degree adjusting lid 28 decreases, and the opening degree of the entrance side exhaust path 26 (opening angle θ of the opening degree adjusting lid 28) becomes small.

In the vicinity of an upper end of the entrance side exhaust path 26, a burner 32 is arranged. Accordingly, the inside atmosphere exhausted to the outside through the entrance side exhaust path 26 is ignited by the burner 32 and burnt just after being exhausted.

As shown in FIG. 1, on an upper face of the oil tank chamber 12, an outside air intake path 35 for taking outside air into the oil tank chamber 12 is provided, and further an exit side exhaust path 36 for exhausting the inside atmosphere from the exit side of the carburizing chamber 10 is provided in a manner to branch from the outside air intake path 35.

As shown in FIG. 3, the outside air intake path 35 has an outside air intake path body 37 in a cylindrical shape, which is in communication with the inside of the oil tank chamber 12, and on an upper side of the outside air intake path body 37, there are formed a conical portion 38 which becomes wider upward, and a circumferential portion 39 following an upper end of the conical portion 38. Inside the conical portion 38, a lid 40 is arranged, where normally the lid 40 is lowered by a not-shown raising/lowering mechanism, and thereby the circumferential edge of the lid 40 is in tight contact with an inside face of the conical portion 38 so as to close an upper end of the outside air intake path 35, as shown by a solid line in FIG. 3. Thus, there is created a state such that the outside air does not enter the inside of the oil tank chamber 12 via the outside air intake path 35.

On the other hand, when the lid 40 is raised by the not-shown raising/lowering mechanism, the circumferential edge of the lid 40 moves away upward from the inside face of the conical portion 38, as shown by a dashed line in FIG. 3, to open the upper end of the outside air intake path 35. Thus, there is created a state that the outside air can enter the inside of the oil tank chamber 12 via the outside air intake path 35.

Incidentally, in the state that the outside air can enter the inside of the oil tank chamber 12 via the outside air intake path 35 in this manner, a burner 41 arranged on the inside face of the circumferential portion 39 ignites, and oxygen in the outside air entering the inside of the oil tank chamber 12 from the outside air intake path 35 is consumed for combustion of a flammable gas injected from the burner 41. Thus, the outside air in a state that oxygen is removed therefrom enters the inside of the oil tank chamber 12 from the outside air intake path 35.

The exit side exhaust path 36 provided so as to branch from the outside air intake path 35 is constituted of an exit side exhaust path base 45 in a cylindrical shape which is in communication with a side face of the outside air intake path body 37, and a cylindrical pipe 46 connected to a tip of the exit side exhaust path base 45. The cylindrical pipe 46 has a predetermined inside diameter L, and the opening area of the cylindrical pipe 46 is set smaller than opening areas of the exit side exhaust path base 45 and the outside air intake path body 37.

Normally, the upper end of the outside air intake path 35 is closed by the lid 40, but via the exit side exhaust path 36 constituted of the exit side exhaust path base 45 and the cylindrical pipe 46, the inside atmosphere of the carburizing chamber 10 is exhausted to the outside also from the exit side. However, with the cylindrical pipe 46 having the predetermined inside diameter L, the amount of the inside atmosphere exhausted from the exit side of the carburizing chamber 10 is restricted in proportion to the inside diameter L.

In the vicinity of an upper end of the cylindrical pipe 46 arranged vertically, a burner 50 is arranged. Thus, just after being exhausted, the inside atmosphere exhausted to the outside from the exit side exhaust path 36 is ignited and burnt by the burner 50.

Now, in the sequential gas carburizing apparatus 1 constructed as above, a transforming gas is supplied to the inside of the carburizing chamber 10 from the gas supply path 25. At the same time, the inside atmosphere is exhausted from the entrance side of the carburizing chamber 10 through the entrance side exhaust path 26 provided on the carry-in chamber 11, and also the inside atmosphere is exhausted from the exit side of the carburizing chamber 10 through the outside air intake path 35 provided on the oil tank chamber 12. In this manner, while supplying the transforming gas that is approximately five to ten times the furnace capacity per hour to the inside of the carburizing chamber 10 from the gas supply path 25, the inside atmosphere is exhausted from the entrance side and the exit side of the carburizing chamber 10, thereby avoiding unevenness in carburization due to differences in positions inside the carburizing chamber 10 (positions in a furnace), disturbance in furnace atmosphere due to flowing-in of outside air into the furnace, or risk of explosion or the like due to flowing-in of the outside air. Note that the inside atmospheres exhausted from the entrance side exhaust path 26 and the outside air intake path 35 are ignited by the burners 32, 50 respectively and burnt just after being exhausted.

Here, on the entrance side exhaust path 26, the opening degree of the entrance side exhaust path 26 (opening angle θ of the opening degree adjusting lid 28) is adjusted by operating the screw rod 30, and thereby the pressure inside the carburizing chamber 10 is adjusted to a desired furnace pressure. Specifically, when the projecting amount of the tip of the screw rod 30 is increased to increase the opening degree of the entrance side exhaust path 26 (opening angle θ of the opening degree adjusting lid 28), a resisting force applied when the inside atmosphere of the carburizing chamber 10 is exhausted from the entrance side exhaust path 26 is small, and thus the pressure inside the carburizing chamber 10 becomes low. Inversely, when the projecting amount of the tip of the screw rod 30 is decreased to reduce the opening degree of the entrance side exhaust path 26 (opening angle θ of the opening degree adjusting lid 28), the resisting force applied when the inside atmosphere of the carburizing chamber 10 is exhausted from the entrance side exhaust path 26 is large, and thus the pressure inside the carburizing chamber 10 becomes high. Accordingly, by appropriately adjusting the opening degree of the entrance side exhaust path 26 (opening angle θ of the opening degree adjusting lid 28), the pressure inside the carburizing chamber 10 is adjusted to a desired furnace pressure (positive pressure of approximately 5 mmAq to 10 mmAq for example).

Also, while adjusting the pressure inside the carburizing chamber 10 to a desired furnace pressure in this manner, by adjusting a supply amount (flow amount) A of the transforming gas supplied from the gas supply path 25 to the inside of the carburizing chamber 10, the ratio B:C of the exhaust amount B from the exit side exhaust path 35 and the exhaust amount C from the entrance side exhaust path 26 is adjusted to be within the range of 3:7 to 2:8 for example. In this case, the ratio B:C of the exhaust amount B from the exit side exhaust path 35 and the exhaust amount C from the entrance side exhaust path 26 can be adjusted as follows.

Specifically, first, by adjusting the opening degree of the entrance side exhaust path 26 by the angle θ of the opening degree adjusting lid 28 as described above, the pressure inside the carburizing chamber 10 is adjusted to a desired furnace pressure. Then, while the pressure in the carburizing chamber 10 is kept at the desired furnace pressure by fixing the opening degree of the entrance side exhaust path 26, the supply amount A of the transforming gas to the inside of the carburizing chamber 10 is changed. On the other hand, there are checked a change in the exhaust amount B from the exit side exhaust path along with the change of the supply amount A of the transforming gas to the inside of the carburizing chamber 10 in this manner as well as a change in the exhaust amount (A−B) from the entrance side exhaust path. Then, there is checked in advance a relationship of the supply amount A of the transforming gas to the inside of the carburizing chamber 10 under the desired furnace pressure (positive pressure of approximately 5 mmAq to 10 mmAq for example) with a ratio B:(A−B) of the exhaust amount B from the outside air intake path 35 and the exhaust amount (A−B) from the entrance side exhaust path 26.

Then, as will be described later, when the work W is actually treated, according to a relationship checked thus in advance of the supply amount A of the transforming gas to the inside of the carburizing chamber 10 with a ratio B:C of the exhaust amount B form the exit side exhaust path and the exhaust amount C from the entrance side exhaust path, the supply amount (flow amount) A of the transforming gas supplied to the inside of the carburizing chamber 10 from the gas supply path 25 and the furnace pressure are adjusted, so as to control the ratio B:C of the exhaust amount B form the exit side exhaust path 35 and the exhaust amount C from the entrance side exhaust path 26 to be within a desired range (range of 3:7 to 2:8 for example). In this case, it is just needed to adjust the supply amount A of the transforming gas according to a predetermined relationship, it becomes possible to exhaust the inside atmosphere of the carburizing chamber 10 to the entrance side and the exit side by a desired ratio without relying on experiences and/or intuitions of the operator.

Moreover, by heating with the not-shown heaters, the preheating zone 15, the carburizing zone 16, the diffusing zone 17 and the hardening heating zone 18 are heated to arbitrary atmospheric temperatures respectively, where for example, the preheating zone 15, the carburizing zone 16 and the diffusing zone 17 are kept at an atmospheric temperature of approximately 930° C., and the hardening heating zone 18 is kept at an atmospheric temperature of approximately 930° C.

Here, as described above, while the transforming gas is supplied to the inside of the carburizing chamber 10 from the gas supply path 25, the inside atmosphere is exhausted both from the entrance side and the exit side of the carburizing chamber 10 through the entrance side exhaust path 26 provided on the carry-in chamber 11 and the outside air intake path 35 provided on the oil tank chamber 12. However, the supply amount A of the transforming gas is adjusted under the desired furnace pressure (positive pressure of approximately 5 mmAq to 10 mmAq for example) so as to control the ratio B:C of the exhaust amount B form the exit side exhaust path 35 and the exhaust amount C from the entrance side exhaust path 26 to be within a desired range (range of 3:7 to 2:8 for example). Thus, the CP hardly increases in the hardening heating zone 18 which has a lower temperature as compared to the other zones 15 to 17, and thereby the CP is kept at a desired value (0.8% for example) in all of the preheating zone 15, the carburizing zone 16, the diffusing zone 17 and the hardening heating zone 18.

While a carburizing atmosphere is formed inside the carburizing chamber 10 in this manner, the door 20 is opened to carry a work W such as an automobile part into the carry-in chamber 11, and the work W is carried from the carry-in chamber 11 to the carburizing chamber 10. Then, inside the carburizing chamber 10, the work W is carried sequentially from the entrance side to the exit side, for being subjected to respective treatments of preheating, carburizing, diffusing and hardening sequentially in the preheating zone 15, the carburizing zone 16, the diffusing zone 17 and the hardening heating zone 18. In this case, since all the preheating zone 15, the carburizing zone 16, the diffusing zone 17 and the hardening heating zone 18 are kept at the desired CP (0.8% for example) as described above, the carburizing treatment on the work W can be controlled precisely.

Next, the door 22 is opened, and the work W subjected to the carburizing treatment in the carburizing chamber 10 in this manner is carried into the oil tank chamber 12 to be subjected to oil hardening. Then, after the oil-hardening treatment is completed, the door 21 is opened and the work W is carried out of the oil tank chamber 12.

When the door 21 is opened or when the door 22 is opened or closed in this manner, a pressure inside the oil tank chamber 12 or the carburizing chamber 10 may become a negative pressure temporarily. In such a case, the lid 40 opens in the outside air intake path 35 explained above with FIG. 3 to take in outside air to the inside of the oil tank chamber 12 from the outside air intake path 35. At this time, by ignition of the burner 41, the outside air in a state that oxygen is removed therefrom enters the inside of the oil tank chamber 12, and thus the risk of explosion or the like is avoided.

As above, an example of the preferred embodiment of the present invention is shown, but it is needless to say that the present invention is not limited to the embodiment explained here but may be changed and implemented appropriately. In this embodiment, a structure is presented in which the exit side exhaust path 36 is branched from the outside air intake path 35, but these outside air intake path 35 and exit side exhaust path 36 may be constructed separately. Also, the entire exit side exhaust path 36 may be formed of the cylindrical pipe 46 having a predetermined inside diameter L.

Before the carry-in chamber 11 or after the oil tank chamber 12 for oil hardening, a purge chamber for purging a work W with an inert (noncombustible) gas when the work W is carried in or out, and/or a curtain burner may be provided. Also, inside the carburizing chamber 10, a fan or the like may be provided other than the heaters. Also, carrying of the work W inside the sequential gas carburizing apparatus 1 can be performed appropriately with a roller house conveyor or a pusher.

Figure 4:
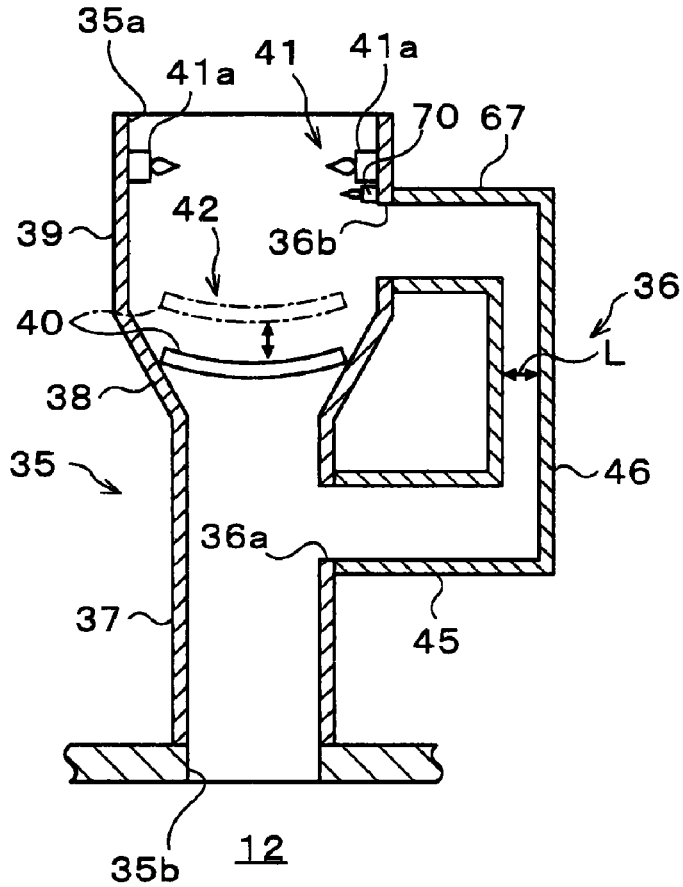
FIG. 4 A vertical cross-sectional view of an exit side exhaust path and an outside air intake path according to another embodiment.

Incidentally, with the above structures (structures of the outside air intake path 35, the exit side exhaust path 36, and so on shown in FIG. 3 for example), if the pressure inside the oil tank chamber 12 or the carburizing chamber 10 becomes a negative pressure when the door 22 of the oil tank chamber 12 is opened when a work is moved from the carburizing chamber 10 to the oil tank chamber 12 for example, it is possible that the outside air flows in not only from the outside air intake path 35 but also from the exit side exhaust path 36. In this case, it is conceivable that a pilot burner 50 disposed at an exit end of the exit side exhaust path 36 consumes oxygen in the outside air flowing in from the exit side exhaust path 36 for combustion, and thus flowing in of oxygen can be prevented. However, when it is desirable to prevent flowing in of oxygen more effectively, an entrance end of the exit side exhaust path 36 may be connected to a middle portion of the outside air intake path 35, and the exit end of the exit side exhaust path 36 may be connected between the burner 41 and the lid 40 of the opening/closing mechanism 62 for example as shown in FIG. 4. In this manner, not only the oxygen flowing in from the outside air intake path 35 but also the oxygen flowing in from the exit side exhaust path 36 can be consumed for combustion by the same burner 41. Therefore, flowing in of oxygen into the oil tank chamber 12 and the carburizing chamber 10 can be prevented more securely.

Similarly to the above-described outside air intake path 35 (refer to FIG. 3), an outside air intake path 35 shown in FIG. 4 is constituted of an outside air intake path body 37, a conical portion 38, and a circumference portion 39, and has a structure to take in outside air into the sequential gas carburizing apparatus 1 (oil tank chamber 12), and a lid 40 and a burner 41 are arranged inside. Note that in this embodiment, an opening/closing mechanism 62 for opening/closing the outside air intake path 35 between the burner 41 and the carburizing chamber 10 has a structure including the lid 40 and a not-shown raising/lowering mechanism for raising/lowering the lid 40.

The burner 41 injects a combustible gas (hydrocarbon gas ($C_mH_n$)) to the outside air taken in via the outside air intake path 35. The burner 41 is a ring burner, curtain burner, or the like and has a plurality of injection ports 41*a* to inject the combustible gas for example. The injection ports 41*a* are disposed at the same height as each other in a ring form arrangement so as to surround the center portion of the circumferential portion 39. Specifically, it is a structure such that the combustible gas is supplied from the entire circumference to the outside air passing through the outside air intake path 35, so that the outside air and the combustible gas can be mixed efficiently. Note that the lid 40 of the opening/closing mechanism 62 is provided so as to open/close the space between the burner 41 and an opening (upper end portion opening of the circumferential portion 39) 35*a* that is an entrance end when taking in the outside air via the outside air intake path 35.

The exit side exhaust path 36 is constituted of an exit side exhaust path base 45 in a cylindrical shape in communication with a side face of the outside air intake path body 37, a cylindrical pipe 46 in a substantially straight pipe shape connected to a tip of the exit side exhaust path base 45, and a second exit side exhaust path base 67 in a cylindrical shape which is connected to a tip of the cylindrical pipe 46 and in communication with a side face of the circumference portion 39. Specifically, the exit side exhaust path 36 is branched from the outside air intake path 35 and merged thereto on a side portion of the outside air intake path 35, thereby becoming a detour (bypass) to bypass the lid 40. The opening 36*a* which is an entrance end of the exit side exhaust path 36 when exhausting is connected to a middle portion of the outside air intake path 35 between the lid 40 of the opening/closing mechanism 62 and an opening (lower end portion opening of the outside air intake path body 37 connected to the oil tank chamber 12) 35*b*, which is an exit end of the outside air intake path 35 when taking in the outside air. An opening 36*b* which is an exit end of the exit side exhaust path 36 when exhausting is connected to a middle portion of the outside air intake path 35 between the burner 41 and the lid 40 of the opening/closing mechanism 62.

The cylindrical pipe 46 has a predetermined inside diameter L, and the opening area of the cylindrical pipe 46 is set smaller than opening areas of the exit side exhaust path base 45, the second exit side exhaust path base 67 and the outside air intake path body 37. Also, the cylindrical pipe 46 is arranged on the outside of the outside air intake path 35 in parallel to the outside air intake path 35.

In the vicinity of the opening 36*b* of the exit side exhaust path 36, a pilot burner 70 for igniting the inside atmosphere exhausted by the exit side exhaust path 36 is provided. This pilot burner 70 may be arranged in the vicinity of an injection port 41*a*. For example, it may be arranged between the opening 36*b* and the injection port 41*a* located on an upper side of the opening 36*b*. In this manner, the pilot burner 70 can also ignite the combustible gas injected from the injection port 41*a*. In other words, the pilot burner 70 can also be used as a pilot burner for igniting the burner 41.

In such a structure, when the outside air intake path 35 is closed by the lid 40, the atmosphere in the oil tank chamber 12 flows into the outside air intake path 35 from the oil tank chamber 12 through the opening 35*b*, flows into the exit side exhaust path 36 between the opening 35*b* and the lid 40, further flows into the outside air intake path 35 from the exit side exhaust path 36 between the lid 40 and the burner 41, and is exhausted to the outside of the sequential gas carburizing apparatus 1 through the opening 35*a* of the outside air intake path 35. Thus, exhaustion is performed through the opening 35*b* of the outside air intake path 35, the exit side exhaust path 36, and the opening 35*a*. Therefore, the inside atmosphere of the carburizing chamber 10 passes through the oil tank chamber 12, the opening 35*b* of the outside air intake path 35, the exit side exhaust path 36, and the opening 35*a* in this order, and is exhausted to the outside of the sequential gas carburizing apparatus 1. The amount of the inside atmosphere exhausted from the exit side exhaust path 36 is restricted in proportion to the inside diameter L.

Also, the inside atmosphere exhausted from the exit side exhaust path 36 can be ignited and burnt by the pilot burner 70 just after being exhausted. Specifically, combustible hydrocarbon gas (CH) and carbon monoxide gas (CO) included in the inside atmosphere are burned in the vicinity of the exits of the entrance side exhaust path 26 and the exit side exhaust path 36 respectively, combined with oxygen ($O_2$) in the outside air and divided into carbon dioxide gas ($CO_2$) and water vapor ($H_2O$), and released safely to the outside of the sequential gas carburizing apparatus 1. Further, when the outside air intake path 35 is closed by the lid 40, the burner 41 is not needed to be ignited, and thus it is preferable that the injection of combustible gas by the burner 41 is stopped. The pilot burner 50 may be operated constantly so that the exhausted internal atmosphere is always ignited.

On the other hand, in a state that the outside air intake path 35 is opened and the outside air can enter the inside of the oil tank chamber 12 when the pressure in the oil tank chamber 12 becomes a negative pressure, the combustible gas is injected from the burner 41, and the burner 41 is ignited by the pilot burner 70. Specifically, the oxygen ($O_2$) in the outside air taken in from the opening 35*a* of the outside air intake path 35 is consumed for combustion of the combustible gas injected by the burner 41, and thereby carbon dioxide ($CO_2$) and water ($H_2O$) are generated. Thus, the outside air in a state that oxygen is turned into carbon dioxide ($CO_2$) and water ($H_2O$) is taken into the oil tank chamber 12 through the outside air intake path 35.

Also, when the pressure in the oil tank chamber 12 becomes a negative pressure and the outside air is taken into the inside of the oil tank chamber 12 from the outside air intake path 35 as described above, the outside air flows into the oil tank chamber 12 at the same time also from the exit side exhaust path 36, but this outside air flowing into the exit side exhaust path 36 passes by the burner 41 in advance and is used for combustion by the burner 41. Specifically, also in the outside air flowing toward the oil tank chamber 12 via the exit side exhaust path 36, oxygen in the outside air is consumed for combustion of the combustible gas, and carbon dioxide and water vapor are produced. Thus, in a state that oxygen is turned into carbon dioxide or water vapor, the outside air enters the inside of the oil tank chamber 12 from the exit side exhaust path 36.

Thus, by injecting the combustible gas from the burner 41 to the outside air flowing in from the outside air intake path 35 and the outside air flowing in from the exit side exhaust path 36 and burning the combustible gas, oxygen in the outside air can be consumed for combustion of the combustible gas and turned into a state of carbon dioxide and water vapor before the outside air flows into the oil tank chamber 12 or the carburizing chamber 10 via the outside air intake path 35 or the exit side exhaust path 36. Therefore, increase of oxygen ($O_2$) concentration in the oil tank chamber 12 or the carburizing chamber 10 can be prevented securely, and the oil tank chamber 12 and the carburizing chamber 10 can be maintained substantially in an oxygen-free state therein. Specifically, oxygen in an active state which possibly oxidizes a work can be reduced and turned into a state of carbon dioxide that is inert and water vapor. Thus, oxidization of a work can be prevented, and deterioration in quality of a work such as change of color can be prevented effectively.

Also, for example, when the exit side exhaust path 36 is not connected between the burner 41 and the lid 40 (for example, when the exit side exhaust path base 67 is not provided, and the tip of the cylindrical pipe 46 is open in the outside air (refer to FIG. 3)), it is necessary, for securely consuming oxygen in the outside air flowing in from the exit side exhaust path 36 for combustion, that the burner 41 is provided separately on the exit side exhaust path 36. However, as shown in FIG. 4, when the exit side exhaust path 36 is connected between the burner 41 and the lid 40, it is no longer necessary to provide the burner 41 on the exit side exhaust path 36 separately. Specifically, it is possible to consume the oxygen in the outside air taken in from the outside air intake path 35 and the oxygen in the outside air flowing in from the exit side exhaust path 36 for combustion by the same burner 41 provided on the outside air intake path 35. Therefore, it is possible to decrease the equipment cost.

The above embodiment is constructed such that the opening 36*a* that is the entrance end of the exit side exhaust path 36 is connected to a middle portion of the outside air intake path 35, but the opening 36*a* may be connected directly to the inside of the sequential gas carburizing apparatus 1 (oil tank chamber 12). Specifically, it may be constructed such that the inside atmosphere flows from the oil tank chamber 12 to the exit side exhaust path 36 directly without intervention of the outside air intake path 35. Also, the entire exit side exhaust path 36 may be constructed by the cylindrical pipe having a predetermined diameter L.

Figure 5:
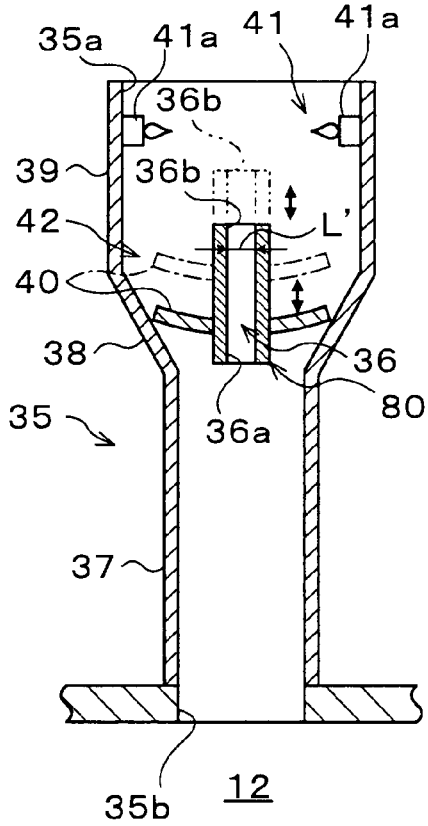
FIG. 5 A vertical cross-sectional view of an exit side exhaust path and an outside air intake path according to still another embodiment.

In the above-described embodiments, the embodiments shown as examples in FIG. 3 and FIG. 4 have a structure such that the exit side exhaust path 36 is arranged outside the outside air intake path 35 and the openings 36*a*, 36*b* are connected to the side portions of the outside air intake path 35, but as shown in FIG. 5 for example, it is also possible to arrange the exit side exhaust path 36 inside the outside air intake path 35, and connect the openings 36*a*, 36*b* to the outside air intake path 35 inside the outside air intake path 35. As shown in FIG. 5, the exit side exhaust path 36 is constituted of a cylindrical pipe 80 attached to a lid 40. The cylindrical pipe 80 is a substantially straight pipe having a predetermined inside diameter L', and is provided for example so as to penetrate vertically a center portion of the lid 40 which is in a substantially circular shape in a plan view. A lower end portion opening of the cylindrical pipe 80, specifically, an opening 36*a* which is an entrance end of the exit side exhaust path 36 is provided below the lid 40 between a lower face of the lid 40 and an opening 35*b* of the outside air intake path 35. An upper end portion opening of the cylindrical pipe 80, specifically, an opening 36*b* which is an exit end of the exit side exhaust path 36 is provided between an upper face of the lid 40 and a burner 41. In other words, this exit side exhaust path 36 is branched from and merged to the outside air intake path 35 inside the outside air intake path 35.

The cylindrical pipe 80 is moved to be raised/lowered integrally with the lid 40 along with up/down movement of the lid 40 by driving of a not-shown raising/lowering mechanism of the opening/closing mechanism 62. In this manner, while the cylindrical pipe 80 is raised/lowered, the opening 36*a* is always arranged between the lid 40 and the opening 35*b*, and the opening 36*b* is always arranged between the lid 40 and the burner 41. Therefore, a space below the lid 40 and a space thereabove are constantly in communication with each other via the exit side exhaust path 36. Specifically, when the lid 40 is lowered and the outside air intake path 35 is closed by the lid 40, the atmosphere inside the oil tank chamber 12 can be exhausted through the opening 35*b* of the outside air intake path 35, the exit side exhaust path 36, and the opening 35*a*. The amount of the inside atmosphere to be exhausted is restricted in proportion to the inside diameter L'. When the lid 40 is raised and the outside air intake path 35 is opened, there is created a state such that the outside air can be taken into the inside of the oil tank chamber 12 from the outside air intake path 35, and at the same time, the outside air also flows from the exit side exhaust path 36 into the oil tank chamber 12. However, the outside air flowing into this exit side exhaust path 36 passes by the burner 41 in advance and used for combustion by the burner 41. In this manner, also in such a structure, the outside air passing through the exit side exhaust path 36 can flow into the oil tank chamber 12 and the carburizing chamber 10 in a state that oxygen included therein is consumed for combustion.

The above embodiments have a structure such that the outside air intake path 35 is attached to the upper face of the oil tank chamber 12, the outside air is made to flow in via a ceiling portion of the oil tank chamber 12, and also the inside atmosphere is exhausted via the exit side exhaust path 36 from the ceiling portion of the oil tank chamber 12. However, the outside air intake path 35 may be attached to a side face of the oil tank chamber 12. Specifically, it may be constructed such that the outside air flows in via a side portion of the oil tank chamber 12, and also the internal atmosphere is exhausted from a side portion of the oil tank chamber 12 via the exit side exhaust path 36.

Figure 6:
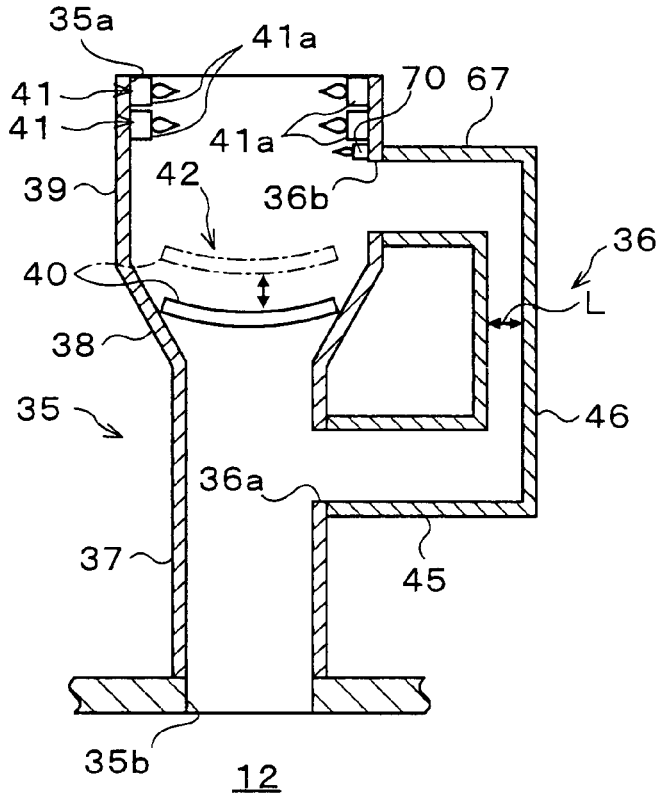
FIG. 6 A vertical cross-sectional view of an exit side exhaust path and an outside air intake path according to an embodiment including two burners.
Figure 7:
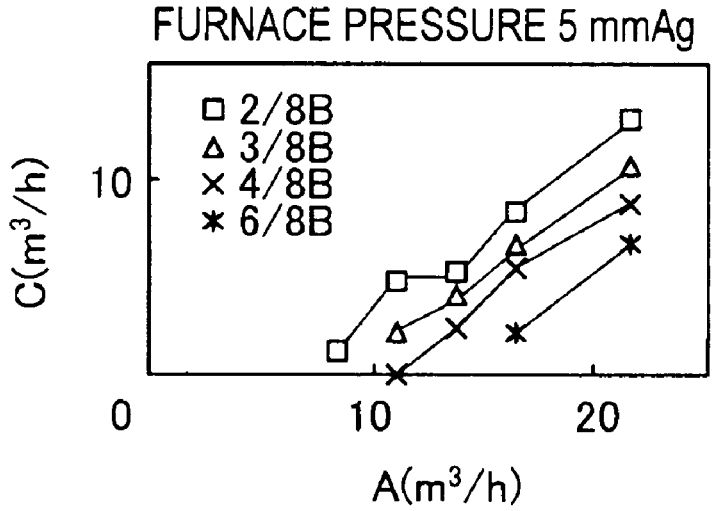
FIG. 7 A graph showing a relationship of a supply amount A with an exhaust amount C from an entrance side exhaust path with a furnace pressure of 5 mmAq.

The burner 41 of the outside air intake path 35 may be provided as a plurality of burners 41. For example, as shown in FIG. 6, two burners 41 may be provided in a vertical arrangement, and a plurality of injection ports 41*a* may be provided as two vertical levels in a ring shape. Further, the number of injection ports 41*a* injecting combustible gas may be adjusted according to the pressure inside the oil tank chamber 12, namely the flow amount of the outside air sucked into the oil tank chamber 12. For example, when the flow amount of the outside air sucked in is small, the combustible gas may be injected from only one of the two burners 41, and when the flow amount of the outside air sucked in is large, the combustible gas may be injected from the two burners 41 together.

In the above embodiments, as an atmosphere heat treatment apparatus, the sequential gas carburizing apparatus 1 for performing a carburizing treatment of a work W is shown as an example, but the present invention can also be applied to various other atmosphere heat treatment apparatuses performing heat treatment other than the carburizing treatment. The atmosphere heat treatment apparatus may be a carbonitriding apparatus performing carbonitriding treatment or a nitriding apparatus performing nitriding treatment for example. Also, the atmosphere heat treatment apparatus is not limited to an apparatus performing a surface heat treatment of steel material, but may be an apparatus performing a general heat treatment, such as a sequential gas conditioning apparatus for performing conditioning. Specifically, the atmosphere heat treatment apparatus may be an apparatus for performing heat treatment such as annealing, hardening, tempering, or the like for example. Also, the atmosphere heat treatment apparatus is not limited to a sequential type heat treatment apparatus, but may be a batch-type heat treatment apparatus.

The carburizing chamber 10 has a structure constituted of the preheating zone 15, the carburizing zone 16, the diffusing zone 17 and the hardening heating zone 18, but the structure inside the carburizing chamber 10 is not limited to such a structure. Also, the carburizing chamber 10 for performing carburizing is shown as an example of a heat treatment chamber in the above-described embodiment, but the heat treatment chamber can be changed appropriately according to the type of an atmosphere heat treatment apparatus, and may be for example a carbonitriding chamber, a nitriding chamber, a heat treatment chamber performing conditioning, or the like.

Example 1

In the cases that the inside diameter L (inside diameter L of the cylindrical pipe) of the exit side exhaust path is 2/8 B, 3/8 B, 4/8 B and 6/8 B (B means an inch) in the sequential gas carburizing apparatus explained in FIG. 1 and so on, and the exit side exhaust path is constituted of each of the cylindrical pipes having the inside diameters L, relationships of a supply amount A of a transforming gas to the inside of the carburizing chamber with a ratio B:C of an exhaust amount B from an exit side exhaust path and an exhaust amount C from the entrance side exhaust path were checked.

Figure 8:
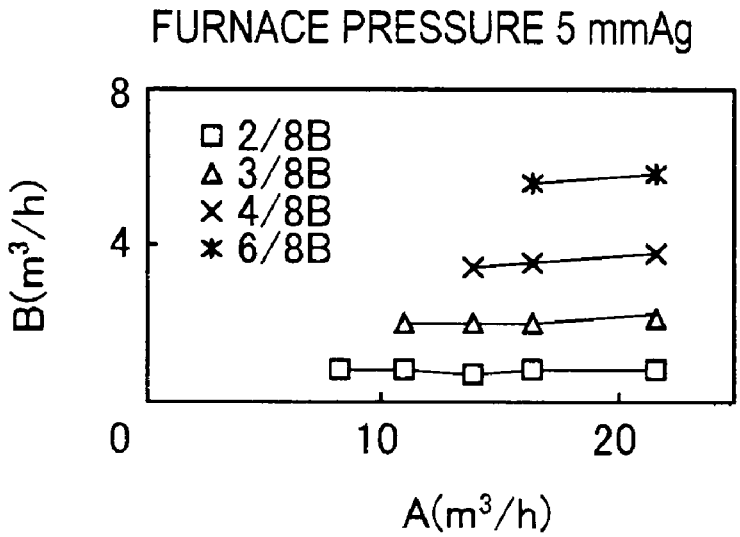
FIG. 8 A graph showing a relationship of the supply amount A with an exhaust amount B from the exit side exhaust path with a furnace pressure of 5 mmAq.

First, the opening degree of the entrance side exhaust path was adjusted, and the pressure (furnace pressure) in the carburizing chamber was adjusted to 5 mmAq. Then, a relationship of the supply amount A with the exhaust amount C from the entrance side exhaust path was checked in a state that the furnace pressure is 5 mmAq, and results as shown in FIG. 8 were obtained. Also, a relationship of the supply amount A with the exhaust amount B from the exit side exhaust path was checked, and results as shown in FIG. 8 were obtained.

Figure 9:
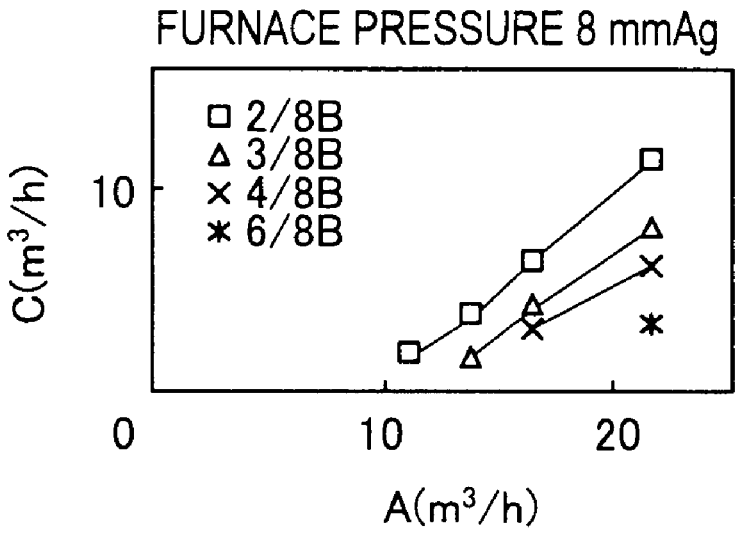
FIG. 9 A graph showing a relationship of the supply amount A with the exhaust amount C from the entrance side exhaust path with a furnace pressure of 8 mmAq.
Figure 10:
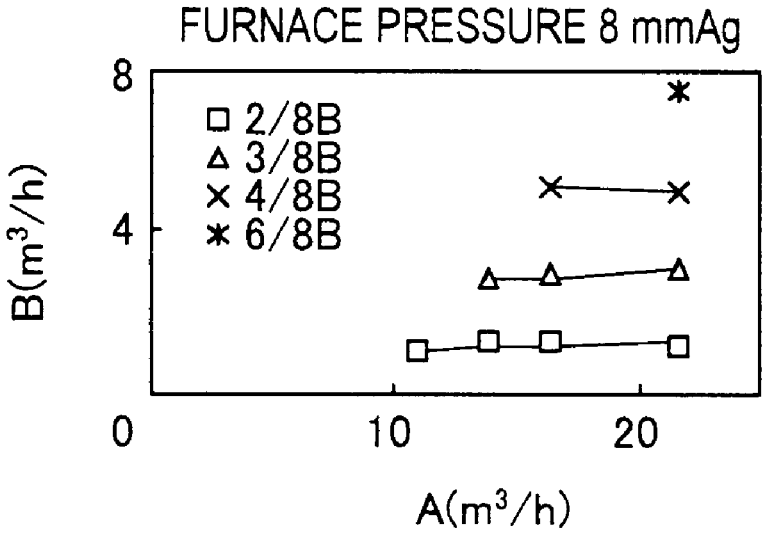
FIG. 10 A graph showing a relationship of the supply amount A with the exhaust amount B from the exit side exhaust path with a furnace pressure of 8 mmAq.

Next, the opening degree of the entrance side exhaust path was adjusted, and the pressure (furnace pressure) in the carburizing chamber was adjusted to 8 mmAq. Then, a relationship of the supply amount A with the exhaust amount C from the entrance side exhaust path was checked in a state that the furnace pressure is 8 mmAq, and results as shown in FIG. 9 were obtained. Also, a relationship of the supply amount A with the exhaust amount B from the exit side exhaust path was checked, and results as shown in FIG. 10 were obtained.

Figure 11:
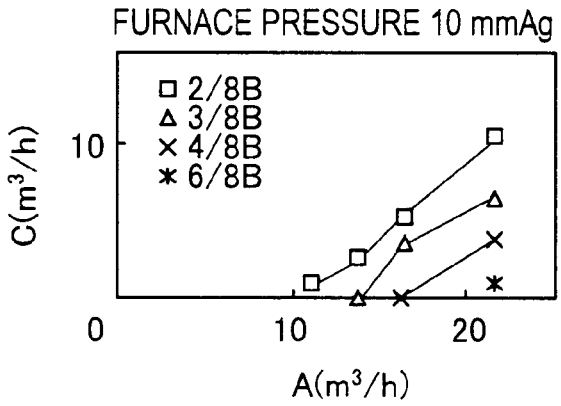
FIG. 11 A graph showing a relationship of the supply amount A with the exhaust amount C from the entrance side exhaust path with a furnace pressure of 10 mmAq.
Figure 12:
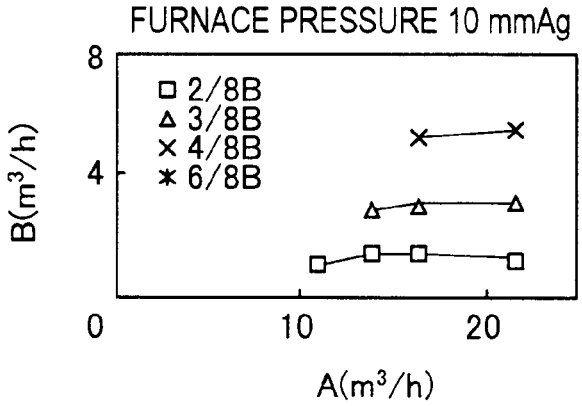
FIG. 12 A graph showing a relationship of the supply amount A with the exhaust amount B from the exit side exhaust path with a furnace pressure of 10 mmAq.

Further, the opening degree of the entrance side exhaust path was adjusted, and the pressure (furnace pressure) in the carburizing chamber was adjusted to 10 mmAq. Then, a relationship of the supply amount A with the exhaust amount C from the entrance side exhaust path was checked in a state that the furnace pressure is 10 mmAq, and results as shown in FIG. 11 were obtained. Also, a relationship of the supply amount A with the exhaust amount B from the exit side exhaust path was checked, and results as shown in FIG. 12 were obtained.

From these FIG. 7 to FIG. 12, the following facts were found. Specifically, when the furnace pressure and the inside diameter L of the exit side exhaust path are constant, the exhaust amount C from the entrance side exhaust path is in proportion to the supply amount of the transforming gas to the inside of the carburizing chamber. The exhaust amount C of the entrance side exhaust path increases as the inside diameter L of the exit side exhaust path decreases. The exhaust amount B from the exit side exhaust path only depends on the furnace pressure and the inside diameter L of the exit side exhaust path, and does not depend on the supply amount A of the transforming gas to the inside of the carburizing chamber. The exhaust amount B from the exit side exhaust path increases along with increase of the furnace pressure. The exhaust amount B from the exit side exhaust path increases as the inside diameter L increases.

Figure 13:
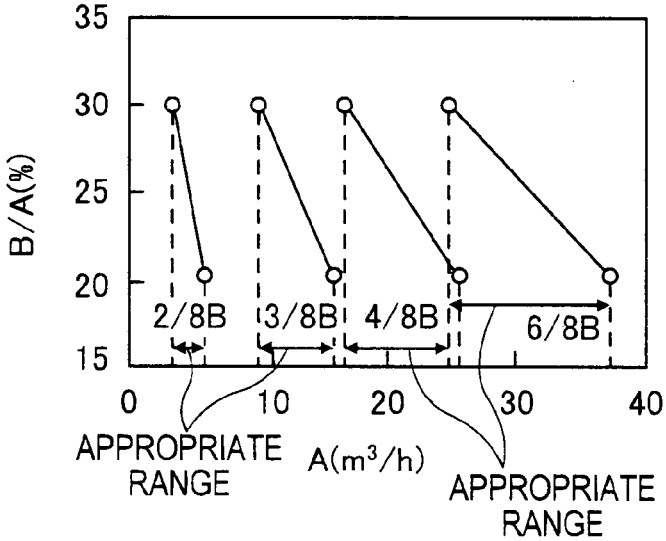
FIG. 13 A graph showing a relationship of the supply amount A of a transforming gas to the inside of a carburizing chamber with a ratio B:C of the exhaust amount B from the exit side exhaust path and the exhaust amount C from the entrance side exhaust path with a furnace pressure of 8 mmAq.

Also, a relationship of the supply amount A of the transforming gas to the inside of the carburizing chamber with the ratio B:C of the exhaust amount B from the exit side exhaust path and the exhaust amount C from the entrance side exhaust path in a state that the furnace pressure is 8 mmAq became as shown in FIG. 13. In FIG. 13, an appropriate range in which the ratio B:C with the exhaust amount C becomes 3:7 to 2:8 was exhibited (range in which B/A becomes 30% to 20%).

Example 2

In the sequential gas carburizing apparatus 1 having the structure in which the opening 36*b* that is the exit end of the exit side exhaust path 36 is connected to the outside air intake path 35 between the burner 41 and the lid 40, a carburizing treatment on a work was performed. Then, the oxygen concentration in the oil tank chamber 12 during the carburizing treatment was measured, and the condition of the work after the carburizing treatment was confirmed. As a result, the oxygen ($O_2$) concentration in the oil tank chamber 12 was suppressed to approximately 0.4% to 0.5%. The work after the carburizing treatment had less change in color, and was in a good condition.

Comparative Example

In a sequential gas carburizing apparatus having a structure in which the opening 36*b* that is the exit end of the exit side exhaust path 36 is not connected to the outside air intake path 35 but is made open to the outside air, and other points are mostly the same as in the above-described sequential gas carburizing apparatus 1, a carburizing treatment on a work was performed. As a result, the oxygen concentration in the oil tank chamber 12 was approximately 1.5% to 1.8%, which is higher as compared to the above-described Example 1. On the work after the carburizing treatment, there were black color changes on the entire body.

INDUSTRIAL APPLICABILITY

The present invention can be used for carburizing treatment, conditioning, or the like on a work such as an automobile part for example.

What is claimed is:

1. An atmosphere heat treatment apparatus, comprising:

an entrance side exhaust path for exhausting an inside atmosphere from an entrance side of a heat treatment chamber to which a transforming gas is supplied;

an exit side exhaust path for exhausting the inside atmosphere from an exit side of the heat treatment chamber;

an opening degree adjusting lid attached for adjusting an opening degree of said entrance side exhaust path, an outside air intake path for taking in outside air; and an opening/closing mechanism for opening/closing said outside air intake path wherein a part or whole of said exit side exhaust path is constituted of a pipe having a predetermined inside diameter, wherein said exit side exhaust path is attached to said opening/closing mechanism.

2. The atmosphere heat treatment apparatus according to claim 1, wherein a carry-in chamber for carrying in a work into the heat treatment chamber is provided on the entrance side of the heat treatment chamber, and wherein said entrance side exhaust path is provided in the carry-in chamber.

3. The atmosphere heat treatment apparatus according to claim 1, wherein an oil tank chamber for hardening a work is provided on the exit side of the heat treatment chamber, and wherein said exit side exhaust path is provided on the oil tank chamber.

4. The atmosphere heat treatment apparatus according to claim 1, wherein an oil tank chamber for hardening a work is provided on the exit side of the heat treatment chamber, and wherein said outside air intake path is provided on the oil tank chamber.

5. The atmosphere heat treatment apparatus according to claim 1, wherein an entrance end of said exit side exhaust path is connected to said outside air intake path between said opening/closing mechanism and an exit end of said outside air intake path.

6. The atmosphere heat treatment apparatus according to claim 5, further comprising a burner which consumes oxygen in the outside air taken in from said outside air intake path for combustion, wherein said opening/closing mechanism is provided between said burner and the exit end of said outside air intake path, and wherein an exit end of said exit side exhaust path is connected to said outside air intake path between said burner and said opening/closing mechanism.

7. The atmosphere heat treatment apparatus according to claim 1, wherein the heat treatment chamber is a carburizing chamber.

8. An atmosphere heat treatment apparatus, comprising:

an entrance side exhaust path for exhausting an inside atmosphere from an entrance side of a heat treatment chamber to which a transforming gas is supplied;

an exit side exhaust path for exhausting the inside atmosphere from an exit side of the heat treatment chamber;

an opening degree adjusting lid attached for adjusting an opening degree of said entrance side exhaust path, wherein a part or whole of said exit side exhaust path is constituted of a pipe having a predetermined inside diameter; and a pilot burner for igniting the inside atmosphere exhausted by said exit side exhaust path.

9. The atmosphere heat treatment apparatus according to claim 8, wherein a carry-in chamber for carrying in a work into the heat treatment chamber is provided on the entrance side of the heat treatment chamber, and wherein said entrance side exhaust path is provided in the carry-in chamber.

10. The atmosphere heat treatment apparatus according to claim 8, wherein an oil tank chamber for hardening a work is provided on the exit side of the heat treatment chamber, and wherein said exit side exhaust path is provided on the oil tank chamber.

11. The atmosphere heat treatment apparatus according to claim 8, further comprising: an outside air intake path for taking in outside air; and an opening/closing mechanism for opening/closing said outside air intake path.

12. The atmosphere heat treatment apparatus according to claim 11, wherein an oil tank chamber for hardening a work is provided on the exit side of the heat treatment chamber, and wherein said outside air intake path is provided on the oil tank chamber.

13. The atmosphere heat treatment apparatus according to claim 11, wherein an entrance end of said exit side exhaust path is connected to said outside air intake path between said opening/closing mechanism and an exit end of said outside air intake path.

14. The atmosphere heat treatment apparatus according to claim 13, further comprising a burner which consumes oxygen in the outside air taken in from said outside air intake path for combustion, wherein said opening/closing mechanism is provided between said burner and the exit end of said outside air intake path, and wherein an exit end of said exit side exhaust path is connected to said outside air intake path between said burner and said opening/closing mechanism.

15. The atmosphere heat treatment apparatus according to claim 8, wherein the heat treatment chamber is a carburizing chamber.

16. A method of operating an atmosphere heat treatment apparatus including an entrance side exhaust path for exhausting an inside atmosphere from an entrance side of a heat treatment chamber to which a transforming gas is supplied, an exit side exhaust path for exhausting the inside atmosphere from an exit side of the heat treatment chamber, and an opening degree adjusting lid attached for adjusting an opening degree of the entrance side exhaust path, wherein a part or whole of the exit side exhaust path is constituted of a pipe having a predetermined inside diameter, the method comprising:

in advance of treating a work, checking a relationship of a supplying amount A of the transforming gas with a ratio B:C of an exhaust amount B from the exit side exhaust path and an exhaust amount C from the entrance side exhaust path when a pressure in the heat treatment chamber is adjusted to a predetermined furnace pressure by adjusting an opening degree of the entrance side exhaust path with the opening degree adjusting lid; and when treating the work, adjusting the supplying amount A of the transforming gas and a furnace pressure so as to control the ratio B:C of the exhaust amount B from the exit side exhaust path and the exhaust amount C from the entrance side exhaust path to be within a predetermined range.

17. The method of operating the atmosphere heat treatment apparatus according to claim 16, wherein the atmosphere heat treatment apparatus comprises an outside air intake path for taking in outside air, and wherein when the outside air intake path is opened, oxygen in the outside air is consumed for combustion, and then the outside air is taken in via the outside air intake path.

18. The method of operating the atmosphere heat treatment apparatus according to claim 17, wherein when outside air flows into the apparatus through the exit side exhaust path when a pressure in the apparatus becomes a negative pressure, oxygen in the outside air flowing into the exit side exhaust path is consumed for combustion.

19. The method of operating the atmosphere heat treatment apparatus according to claim 18, wherein oxygen in the outside air taken in from the outside air intake path and oxygen in the outside air flowing in from the exit side exhaust path are consumed for combustion by a same burner.

20. The method of operating the atmosphere heat treatment apparatus according to claim 16, wherein the inside atmosphere exhausted by the exit side exhaust path is ignited by a pilot burner.

21. The method of operating the atmosphere heat treatment apparatus according to claim 16, wherein the heat treatment chamber is a carburizing chamber.

* * * * *